US009309645B2

(12) United States Patent
Yamamoto et al.

(10) Patent No.: US 9,309,645 B2
(45) Date of Patent: Apr. 12, 2016

(54) DRIVE CONTROL METHOD OF OPERATING MACHINE

(75) Inventors: Ryo Yamamoto, Kobe (JP); Masahiro Yamada, Kobe (JP); Yoji Yudate, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 483 days.

(21) Appl. No.: 13/823,784

(22) PCT Filed: Sep. 9, 2011

(86) PCT No.: PCT/JP2011/005087

§ 371 (c)(1),
(2), (4) Date: May 3, 2013

(87) PCT Pub. No.: WO2012/035735

PCT Pub. Date: Mar. 22, 2012

(65) Prior Publication Data

US 2013/0213026 A1 Aug. 22, 2013

(30) Foreign Application Priority Data

Sep. 15, 2010 (JP) ..... 2010-206311

(51) Int. Cl.
*E02F 9/22* (2006.01)
*B66C 23/86* (2006.01)
(Continued)

(52) U.S. Cl.
CPC ..... *E02F 9/2221* (2013.01); *B66C 23/86* (2013.01); *E02F 9/123* (2013.01); *E02F 9/128* (2013.01);
(Continued)

(58) Field of Classification Search
CPC ..... E02F 9/2221; E02F 9/2217; E02F 9/2292; E02F 9/2296
USPC ..... 60/445, 452, 422, 486
See application file for complete search history.

(56) References Cited

U.S. PATENT DOCUMENTS 4,507,057 A * 3/1985 Igarashi et al. ..... 417/216
5,353,686 A * 10/1994 Nakamura ..... 91/461
(Continued)

FOREIGN PATENT DOCUMENTS

JP U-59-181283 12/1984
JP U-63-12667 1/1988
(Continued)

OTHER PUBLICATIONS

Oct. 18, 2011 International Search Report issued in International Patent Application No. PCT/JP2011/005087.

*Primary Examiner* — Thomas E Lazo
(74) *Attorney, Agent, or Firm* — Oliff PLC

(57) ABSTRACT

In drive control of an operating machine configured to drive a structure by a hydraulic motor configured to be driven by operating oil supplied from a hydraulic pump an electric motor configured to cooperate with the hydraulic motor, a speed command generated based on a manipulation amount of a remote control valve configured to determine an operation amount of the structure is subjected to speed feedback control performed based on the actual rotation speed of the hydraulic motor and pressure difference feedback control performed based on an operating oil pressure difference between a suction port and discharge port of the hydraulic motor. With this, a tilting angle command is generated such that the operating oil, the amount of which is necessary at the actual rotation speed of the hydraulic motor, is ejected, and the tilting angle of the hydraulic pump is controlled.

8 Claims, 7 Drawing Sheets

(51) Int. Cl.

| | |
|---|---|
| ***E02F 9/20*** | (2006.01) |
| ***E02F 9/12*** | (2006.01) |
| ***F04B 49/00*** | (2006.01) |
| ***F04B 49/06*** | (2006.01) |
| ***F04B 49/22*** | (2006.01) |

(52) U.S. Cl.

CPC ..... *E02F 9/2095* (2013.01); *E02F 9/225* (2013.01); *E02F 9/2217* (2013.01); *E02F 9/2292* (2013.01); *E02F 9/2296* (2013.01); *F04B 49/002* (2013.01); *F04B 49/06* (2013.01); *F04B 49/22* (2013.01)

(56) References Cited

U.S. PATENT DOCUMENTS

| | | | | |
|---|---|---|---|---|
| 5,636,516 | A * | 6/1997 | Kon | 60/466 |
| 2011/0020146 | A1 * | 1/2011 | Akiyama et al. | 417/213 |

FOREIGN PATENT DOCUMENTS

| | | |
|---|---|---|
| JP | Y2-8-7165 | 3/1996 |
| JP | A-9-195322 | 7/1997 |
| JP | A-2005-290882 | 10/2005 |
| JP | A-2008-63888 | 3/2008 |
| JP | A-2008-291522 | 12/2008 |

* cited by examiner

DRIVE CONTROL METHOD OF OPERATING MACHINE

TECHNICAL FIELD

The present invention relates to a method of controlling a driving device for use in an operating machine, and particularly to a drive control method of an operating machine configured to drive a structure by a hydraulic motor and an electric motor.

BACKGROUND ART

Power machineries, such as hydraulic excavators, cranes, wheel loaders, and bulldozers, (in the present specification and claims, these power machineries (heavy machineries) are collectively called "operating machines") have been used for civil engineering works, construction works, and the like. Taking, the hydraulic excavator as an example, the hydraulic excavator is configured such that: a revolving super structure (structure) is provided on the upper portion of a base carrier; and the revolving super structure includes an engine, a driver's seat, an arm having a tip end on which a bucket is provided, a boom coupled to the arm, and the like. Therefore, the revolving super structure is a large heavy structure. By manipulating a remote control valve at the driver's seat during operations, the revolving super structure is caused to swing on the upper portion of the base carrier. In addition, by manipulating the boom and the like, various operations are performed by the bucket provided at the tip end of the arm.

The revolving super structure is caused to swing by a driving device configured to cause the revolving super structure to swing. In recent years, a device including a hydraulic motor and an electric motor has been proposed as the driving device.

One example of an operating machine including this type of driving device is an operating machine including a driving device which includes an hydraulic unit having a hydraulic motor as a driving source and an electric unit having an electric motor as a driving source, controls the electric motor by a controller and an inverter at the time of swing, and assists the hydraulic twit by the torque of the electric motor (see PTL 1, for example). According to this operating machine, when the driving device performs steady swing or decelerates, the electric motor is caused to perform a regenerative action, and regenerative electric power is stored in a capacitor. A control unit of the driving device calculates required torque at the time of the swing. When the required torque exceeds a set value, the electric motor outputs necessary torque. To be specific, maximum torque necessary as a whole is secured by causing the electric unit to assist the hydraulic unit. In this case, necessary torque is generated by adjusting the assist amount of the electric unit. The control unit is configured to control the output torque of the electric motor so as to shorten a relief time of a relief valve provided at a hydraulic motor circuit.

Further, another prior art is that: a construction machinery including a hybrid driving device having a driving force synthesis mechanism configured to synthesize the driving force of a hydraulic actuator and the driving force of a motor generator includes a communication valve (bypass valve) for effectively utilizing energy generated at the time of braking; and inertial energy of the revolving super structure is efficiently regenerated as electric energy by the motor generator (see PTL 2, for example). In this prior art, the relief valve incorporated in the hydraulic motor is used as a setting unit configured to set a ratio between the driving force of the hydraulic actuator and the driving force of the motor generator configured to cooperate with the hydraulic actuator.

Still another prior art is that: a pressure difference between both ports of the hydraulic actuator is detected; and a torque command is output to the motor generator, provided close to the hydraulic actuator, in accordance with the pressure difference (see PTL 3, for example). In this prior art, the revolving super structure is configured to be driven by the sum of driving and braking torques of the hydraulic motor and the motor generator. The relief valve configured to control highest driving pressure of the hydraulic motor at the time of driving and stopping is provided as an adjusting unit configured to perform adjustments such that the ratio of the output torque of the hydraulic motor at the time of the driving becomes larger than that at the time of the braking. The working pressure of the relief valve at the time of the start-up and acceleration is set to be higher than that at the time of the deceleration and stopping.

CITATION LIST

Patent Literature

PTL 1: Japanese Laid-Open Patent Application Publication No. 2005-290882

PTL 2: Japanese Laid-Open Patent Application Publication No. 2008-291522

PTL 3: Japanese Laid-Open Patent Application Publication No. 2008-63888

SUMMARY OF INVENTION

Technical Problem

As the operations of the structure of the operating machine, operations, such as sand digging and loading operations of the hydraulic excavator, of exponentially accelerating or decelerating the revolving super structure are frequently performed. Therefore, in order to cause the revolving super structure that is the large heavy structure and au inertial body to swing at a desired speed, the remote control valve is quickly, largely manipulated in many cases.

In each of PTLs 1 to 3, the relief valve is used as a hydraulic motor torque adjusting unit for torque share between the hydraulic motor and electric motor for driving the revolving super structure. Therefore, when controlling the torque of the hydraulic motor, the excess of the operating oil ejected from the hydraulic pump is discharged through the relief valve to a tank. Thus, energy loss occurs.

To be specific, by quickly, largely manipulating the remote control valve as described above, a large amount of operating oil is ejected through the hydraulic pump. However, the excess of the operating oil is discharged to the tank until the hydraulic motor reaches the desired speed. Therefore, a part of the energy from the hydraulic pump is wasted, and this decreases the energy use efficiency. This decrease in the energy use efficiency also occurs in a driving device configured to accelerate a structure other than the revolving super structure.

Solution to Problem

Here, an object of the present invention is provide a drive control method of an operating machine, the method being capable of suppressing the energy loss by controlling the amount of oil supplied from the hydraulic pump to the hydraulic motor in accordance with the manipulation amount of the remote control valve, the rotation speed of the hydraulic motor, and the operating oil pressure difference between a suction port and discharge port of the hydraulic motor To achieve the above object, the present invention is a chive control method of an operating machine configured to drive a structure by a hydraulic motor and an electric motor configured to cooperate with the hydraulic motor, the hydraulic motor being configured to be driven by operating oil supplied from a hydraulic pump through a control valve, the hydraulic pump being configured to be able to change an ejection flow rate by control of a tilting angle of the hydraulic pump, the method including the steps of: causing a speed command, generated based on a manipulation amount of a remote control valve configured to determine an operation amount of the structure, to be subjected to speed feedback control, performed based on an actual rotation speed of the hydraulic motor, and pressure difference feedback control, performed based on an operating oil pressure difference between a suction port and discharge port of the hydraulic motor, to generate a tilting angle command such that the operating oil, the amount of which is necessary at the actual rotation speed of the hydraulic motor, is ejected; and controlling the tilting angle of the hydraulic pump. In the present specification and claims, the "structure" denotes, for example, a structure configured to perform a swing movement or a structure configured to perform a straight movement. With this, the tilting angle of the hydraulic pump is controlled such that the hydraulic pump ejects the operating oil, the amount of which is appropriate to obtain by the hydraulic motor the drive torque corresponding to the difference between the manipulation amount of the remote control valve and the actual rotation speed of the hydraulic motor and the amount of which is also appropriate for the actual rotation speed of the hydraulic motor. To be specific, the amount of operating oil supplied from the hydraulic pump to the hydraulic motor can be controlled to an amount appropriate for the actual rotation speed and an amount necessary to obtain the drive torque corresponding to the difference between the manipulation amount of the remote control valve and the actual rotation speed of the hydraulic motor. Thus, the energy efficiency can be improved.

Moreover, the drive control method may further include the step of causing the tilting angle command to be subjected to flow rate compensation such that the operating oil, the amount of which is appropriate for the actual rotation speed of the hydraulic motor, is supplied, the flow rate compensation being performed in such a manner that a speed signal generated based on the actual rotation speed is added through a control gain to a signal obtained by the pressure difference feedback control. With this since the tilting angle command of the hydraulic pump obtained by the pressure difference feedback control is subjected to the flow rate compensation such that the amount of oil necessary for the actual rotation speed is obtained, the tilting angle control of the hydraulic pump can be performed such that the amount of oil ejected becomes the amount of necessary oil corresponding to the changing actual rotation speed. Thus, the responsiveness can be improved.

Further, the drive control method may further include the step of performing pressure increase compensation by providing a minor loop between the tilting angle command obtained by the flow rate compensation and a pressure difference command to which the pressure difference feedback signal is input, the minor loop being configured to perform feedback of a difference of the tilting angle command. With this, the gain of the high frequency range of the tilting angle command subjected to the flow rate compensation can be reduced by the feedback control of the minor loop. Thus, the stability of the pressure control can be improved.

Moreover, set pressure of a solenoid-operated relief valve provided on an oil passage extending between the hydraulic pump and the hydraulic motor may be controlled such that the operating oil ejected from the hydraulic pump beyond a set value of the tilting angle command is released. With this, if the operating oil ejected by the tilting angle control exceeds the set pressure, the operating oil is released through the solenoid-operated relief valve. Thus, the operating oil having stable pressure can be supplied to the hydraulic motor.

Further, the drive control method may further include the step of at the time of deceleration by a reverse lever operation of the remote control valve, minimizing the tilting angle of the hydraulic pump and setting the control valve to a neutral position to generate a deceleration resistance on the hydraulic motor. Examples of the deceleration resistance are brake torque by the electric motor and brake torque by the solenoid-operated relief valve. With this, the loss of the hydraulic pump at the time of the deceleration by the reverse lever operation can be reduced. In addition, the short deceleration time of the hydraulic motor can be secured by increasing the torque of the electric motor or increasing the set pressure of the solenoid-operated relief valve on the brake side.

Moreover, the drive control method may further include the steps of: at the time of the deceleration of the hydraulic motor, causing the operating oil to circulate in a circuit of the hydraulic motor, and recovering an entire amount of deceleration energy in a capacitor by using the electric motor; and minimizing the tilting angle of the hydraulic pump and releasing an entire amount of ejected oil to a tank through the control valve. With this, the substantially entire amount of inertial energy can be efficiently recovered as the electric energy by the regenerative action of the electric motor, and wasteful energy consumption by the hydraulic pump can be suppressed.

Further, the drive control method may include the step of at the time of initial acceleration of the structure, generating the tilting angle command of the hydraulic pump such that a shortfall that is torque obtained by subtracting drive torque, which is able to be output by the electric motor, from torque necessary for the acceleration of the structure is compensated by drive torque of the hydraulic motor. With this, at the time of initial acceleration of the structure that is the inertial body, the chive control is performed while calculating respective energies such that the torque necessary for the acceleration of the structure is compensated by the drive torque which can be output by the electric motor based on the voltage of the capacitor, and the shortfall that is the torque obtained by subtracting the drive torque of the electric motor from the torque necessary for the acceleration of the structure is compensated by the drive torque of the hydraulic motor. Therefore, the use efficiency of the stored electric energy can be improved. In addition, the operating oil supplied to the hydraulic motor is supplied from the hydraulic pump whose tilting angle is controlled such that the shortfall that is the torque obtained by subtracting the drive torque of the electric motor from the torque necessary for the acceleration of the structure is compensated. Therefore, the operations can be performed with high energy efficiency.

Moreover, a drive control method of an operating machine including a hydraulic motor configured to be driven by operating oil supplied from a hydraulic pump based on a manipulation amount of the remote control valve and a second hydraulic actuator configured to be driven by the operating oil supplied from a second hydraulic pump based on a manipulation amount of a second remote control valve, may include the steps of: calculating a tilting angle command in accordance with the drive control method according to any one of claims 1 to 4, the tilting angle command being a command for controlling a tilting angle of the hydraulic pump; comparing a signal generated based on the tilting angle command of the hydraulic pump and a signal generated based on a power limitation of the hydraulic pump and performing lowest selection; controlling the tilting angle of the hydraulic pump in accordance with a signal generated by the lowest selection; comparing a signal generated based on the manipulation amount of the second remote control valve and a signal generated based on a power limitation of the second hydraulic pump and performing the lowest selection, the power limitation being a power limitation obtained by subtracting actual power of a first hydraulic pump from a total of power limitations of the two pumps; and controlling the tilting angle of the second hydraulic pump in accordance with a signal generated by the lowest selection. With this, in the operating machine including a plurality of hydraulic actuators driven by a plurality of hydraulic pumps, the swing of the revolving super structure may be performed such that the shortfall of the drive torque of the electric motor is compensated by the hydraulic motor. Therefore, the drive torque of the electric motor can be used as the drive power of the second hydraulic pump. Thus, the operations can be performed with high energy efficiency while maximally utilizing the stored electric energy and the preset power limitation of the pump of the operating machine.

Advantageous Effects of Invention

According to the present invention, the tilting angle of the hydraulic pump is controlled in accordance with the manipulation amount of the remote control valve such that the amount of operating oil for driving the hydraulic motor becomes most appropriate. Therefore, the energy efficiency for driving the structure by the hydraulic motor can be improved.

BRIEF DESCRIPTION OF DRAWINGS

FIG. 3A is a graph showing a manipulation amount of a remote control valve. FIG. 3B is a graph showing a tilting angle command of the hydraulic pump.

DESCRIPTION OF EMBODIMENTS

Figure 1:
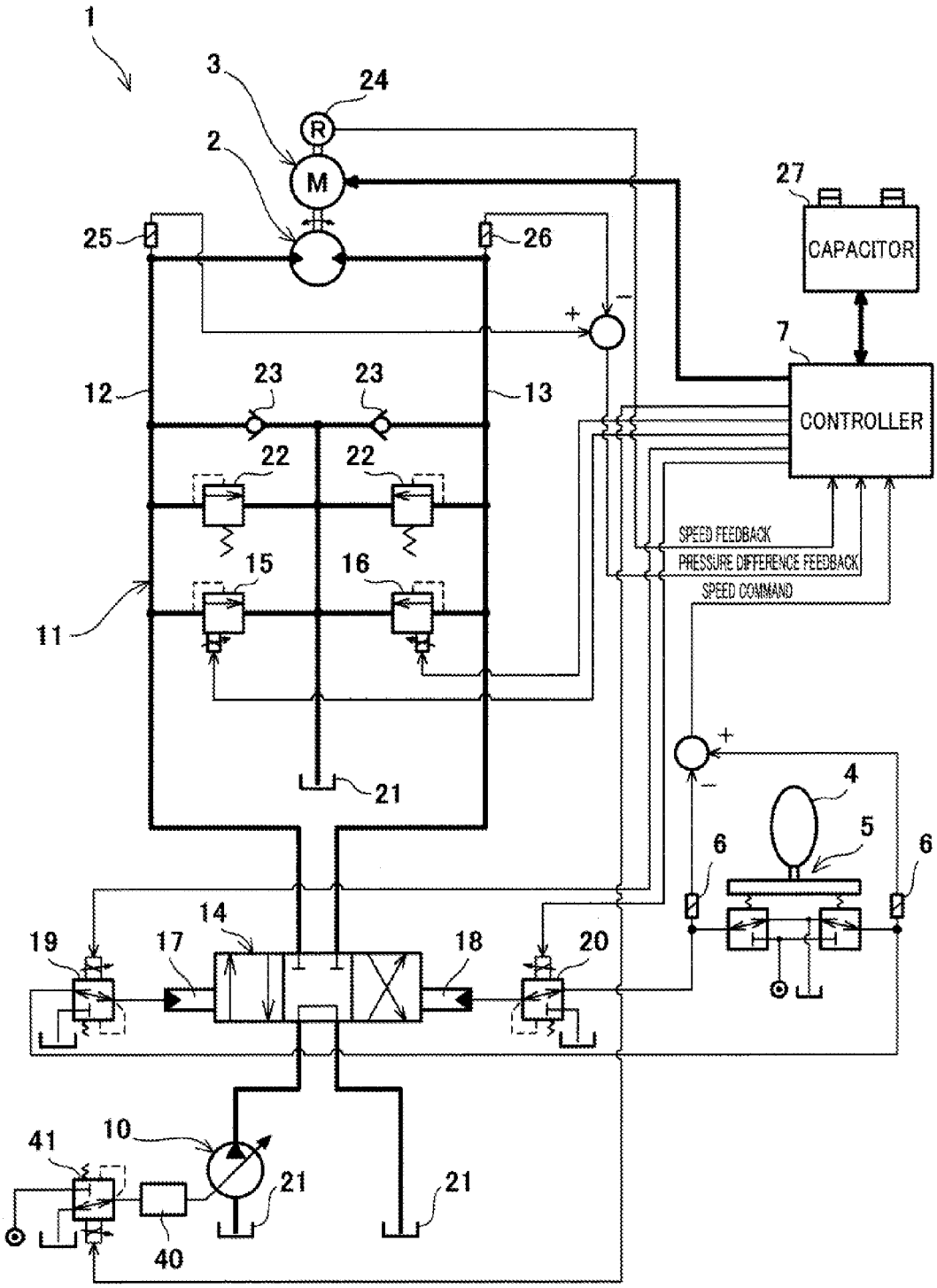
FIG. 1 is a hydraulic circuit diagram of a drive controller according to Embodiment 1 of the present invention.

Hereinafter, embodiments of the present invention will be explained based on the drawings. In the following embodiment, a revolving super structure of a hydraulic excavator (hereinafter simply referred to as a "revolving super structure") will be explained as an example of a structure of an operating machine. As shown in FIG. 1, a drive controller 1 according to Embodiment 1 is configured to swing the revolving super structure (not shown) by a hydraulic motor 2 and an electric motor 3 in cooperation. In addition, the drive controller 1 according to Embodiment 1 is configured such that when the hydraulic motor 2 decelerates, inertial energy (kinetic energy) of the hydraulic motor 2 is converted into electric energy by a regeneration function of the electric motor 3, and the obtained electric energy is recovered. Since the regeneration function of the electric motor 3 which is caused to perform a regenerative action as a power generator is a known technology, a detailed explanation thereof is omitted.

The drive controller 1 includes a remote control valve 5 configured to determine an operation amount of the revolving super structure. The operation amount includes a swing direction, swing speed, and the like of the revolving super structure. The remote control valve 5 includes an inclination handle 4 configured to determine the swing direction of the revolving super structure. The swing direction, speed, and acceleration rate of the revolving super structure are determined by the inclination direction, angle, speed, and the like of the inclination handle 4. The remote control valve 5 is provided with pressure sensors 6 configured to detect secondary pressure corresponding to a manipulation amount of the remote control valve 5. A pressure difference between left and right ports of the remote control valve 5 is detected by the pressure sensors 6 to be input to a controller 7 as a speed command (rotation speed command) for causing the revolving super structure to rotate. When a positive signal corresponds to positive rotation, a negative signal corresponds to negative rotation.

The hydraulic motor 2 is driven by operating oil ejected by a hydraulic pump 10. The hydraulic motor 2 is connected to a hydraulic motor circuit 11 configured to suction the operating oil from the hydraulic pump 10 and discharge the operating oil. Oil passages 12 and 13 connected to the suction port and discharge port of the hydraulic motor 2 in the hydraulic motor circuit 11 are connected through a control valve 14. The suction port and discharge port of the hydraulic motor 2 switch in accordance with a rotational direction of the hydraulic motor 2.

Solenoid-operated relief valves 15 and 16 are provided between the oil passages 12 and 13 of the hydraulic motor circuit 11. When the hydraulic motor 2 decelerates, the oil passages 12 and 13 are caused to communicate with each other through the solenoid-operated relief valves 15 and 16. With this, the loss generated on the discharge side of the hydraulic motor 2 is avoided. Since the flow direction of the operating oil is different between when the hydraulic motor 2 performs the positive rotation and when the hydraulic motor 2 performs the negative rotation, the solenoid-operated relief valve 15 is provided toward the oil passage 13, and the solenoid-operated relief valve 16 is provided toward the oil passage 12.

Further, relief valves 22 and check valves 23 are provided between the oil passages 12 and 13. Each of the relief valves 22 operates so as to release the operating oil to a tank 21 when the pressure of the operating oil exceeds pressure at the time of ordinary use. Each of the check valves 23 suctions the oil from the tank 21 if the amount of oil decreases when the oil is circulating in the oil passages 12 and 13.

In the present embodiment, solenoid-operated proportional reducing valves 19 and 20 are respectively provided at pilot ports 17 and 18 of swing sections of the control valve 14. The secondary pressure of the remote control valve 5 is introduced to the solenoid-operated proportional reducing valves 19 and 20 as primary pressure, and the controller 7 can control the secondary pressure of the solenoid-operated proportional reducing valves 19 and 20. In the present embodiment, inverse proportional solenoid-operated reducing valves are used as the solenoid-operated proportional reducing valves 19 and 20.

Further, pressure sensors 25 and 26 are respectively provided at the suction port and discharge port of the hydraulic motor 2. The difference between the pressure detected by the pressure sensor 25 and the pressure detected by the pressure sensor 26 is input to the controller 7 as pressure difference feedback. By the pressure difference between the suction port and discharge port of the hydraulic motor 2, the torque generated by the hydraulic motor 2 is estimated in the controller 7 (in the case of the negative signal, counter torque).

The electric motor 3 is connected to a capacitor 27 via the controller 7. The capacitor 27 is configured to store electric power for driving the electric motor 3. The capacitor 27 supplies and receives the electric power to and from the electric motor 3 via the controller 7. When the hydraulic motor 2 is accelerating to cause the revolving super structure to rotate, the capacitor 27 discharges and supplies the electric power to the electric motor 3 which cooperates with the hydraulic motor 2. When the hydraulic motor 2 is decelerating, the capacitor 27 stores regenerative electric power obtained by causing the electric motor 3 to perform the regenerative action so as to brake the hydraulic motor 2. As above, when the hydraulic motor 2 accelerates, the controller 7 outputs a rotation command to the electric motor 3 which cooperates with the hydraulic motor 2. When the hydraulic motor 2 decelerates, the controller 7 outputs a regeneration command to the electric motor 3 so as to brake the hydraulic motor 2.

Further, the electric motor 3 is provided with a rotation speed sensor 24. The actual rotation speed detected by the rotation speed sensor 24 is input to the controller 7 as speed feedback. In accordance with this speed feedback, an acceleration rate is obtained in the controller 7 based on the difference between the speed command (rotation speed command) output from the remote control valve 5 and the actual rotation speed.

In order to control the tilting angle of the hydraulic pump 10, a solenoid-operated proportional reducing valve 41 is provided at a tilting angle adjusting port 40. A solenoid current of the solenoid-operated proportional reducing valve 41 is controlled by a signal output from the controller 7. Thus, the tilting angle of the hydraulic pump 10 is controlled. A proportional solenoid-operated reducing valve is used as the solenoid-operated proportional reducing valve 41. The control of the tilting angle of the hydraulic pump 10 by the solenoid-operated proportional reducing valve 41 is performed by a tilting angle command output from the controller 7 such that the operating oil, the amount of which is necessary at the actual rotation speed of the hydraulic motor 2, is ejected in accordance with the speed command of the remote control valve 5.

As specific control by the controller 7, to obtain torque set in the electric motor 3 and the hydraulic motor 2, the electric motor 3 and the hydraulic motor 2 are controlled based on the speed command (rotation speed signal) output from the remote control valve 5, the pressure difference feedback (torque signal) based on a pressure difference signal of the hydraulic motor 2, and the speed feedback (actual rotation speed) based on the rotation speed signal of the electric motor 3. To be specific, the electric motor 3 is caused to rotate, and in order to compensate for the shortfall of the torque of the electric motor 3, the tilting angle command is transmitted to the solenoid-operated proportional reducing valve 41 of the hydraulic pump 10, and the hydraulic motor 2 is caused to rotate by the operating oil supplied from the hydraulic pump 10.

In addition, when the remote control valve 5 is manipulated, and the controller 7 determines that the revolving super structure accelerates, the electric energy capable of driving the electric motor 3 is being stored in the capacitor 27, the electric motor 3 is preferentially driven by this electric energy. In this case, the shortfall of the torque is compensated by the hydraulic motor 2 driven by the operating oil supplied through the hydraulic pump 10 controlled as above. In this period, the solenoid-operated relief valves 15 and 16 do not basically operate. However, the solenoid-operated relief valves 15 and 16 may be subsidiarily used to compensate for a pressure control performance obtained by the control of the tilting angle of the hydraulic pump 10.

To be specific, to obtain the torque corresponding to the shortfall calculated by subtracting the torque of the electric motor 3 from swing drive torque corresponding to the manipulation amount of the remote control valve 5, the hydraulic motor 2 in the drive controller 1 is driven by the operating oil supplied through the hydraulic pump 10 whose tilting angle is controlled such that the solenoid current of the solenoid-operated proportional reducing valve 41 provided at the tilting angle adjusting port 40 of the hydraulic pump 10 is controlled based on the tilting angle command output from the controller 7. In this case, an opening position of the control valve 14 is set such that the pressure loss becomes minimum. This opening position is basically set to a maximum opening position.

In addition, by controlling the tilting angle of the hydraulic pump 10, the distribution of the torque of the electric motor 3 and the torque of the hydraulic motor 2 ran be changed. Therefore, for example, if the stored energy of the capacitor 27 has become equal to or lower than a prescribed value, the torque of the electric motor 3 is radially decreased, and at the same time, the torque of the hydraulic motor 2 is increased. Thus, the switching from the electric motor 3 to the hydraulic motor 2 can be performed smoothly in a shockless manner. Finally, the tilting angle of the hydraulic pump 10 is set to obtain the necessary oil amount determined by the rotation speed command output from the remote control valve 5. Details will be described later. The distribution of the torque of the electric motor 3 and the torque of the hydraulic motor 2 is preset to a ratio by which the energy utilization ratio becomes most preferable. Then, the distribution is changed in accordance with state changes (such as the stored energy of the capacitor 27 being equal to or lower than the prescribed value) related to the torque of the electric motor 3 and the torque of the hydraulic motor 2 such that the total of the torque of the electric motor 3 and the torque of the hydraulic motor 2 becomes the necessary swing drive torque.

In contrast, when the remote control valve 5 is manipulated, and the controller 7 determines that the revolving super structure decelerates, the electric motor 3 is caused to perform the regenerative action, and the regenerative electric power obtained by converting the inertial energy into the electric energy is stored in the capacitor 27. At this time, the solenoid-operated relief valve 15 or 16 on the brake side is set to an unloaded state, and the operating of is caused to circulate. In addition, the tilting angle of the hydraulic pump 10 is set to minimum, and the control valve 14 is completely closed. Thus, the oil ejected from the hydraulic pump 10 is entirely supplied to the tank through the control valve 14. As a result, the consumption energy is minimized.

In a case where it is determined that the entire inertial energy cannot be recovered by the electric motor 3 (for example, in a case where brake torque to be generated by the electric motor 3 has exceeded an acceptable value or in a case where voltage and current control values of the capacitor 27 have exceeded acceptable values), set pressure of the solenoid-operated relief valve 15 or 16 on the brake side is adjusted to increase resistance in the oil passages 12 and 13. With this, the shortfall of the brake torque can be generated by the hydraulic motor 2.

As above, at the time of the acceleration, the necessary generated torque of the hydraulic motor 2 is controlled by the amount of operating oil supplied by adjusting the tilting angle of the hydraulic pump 10, and the solenoid-operated relief valve 15 or 16 does not operate in principle. At the time of the deceleration, the solenoid-operated relief valve 15 or 16 on the brake side is set to the unloaded state, and the operating oil is caused to circulate. In addition, the entire amount of deceleration energy is recovered in the capacitor 27 in principle by using the electric motor.

Figure 2:
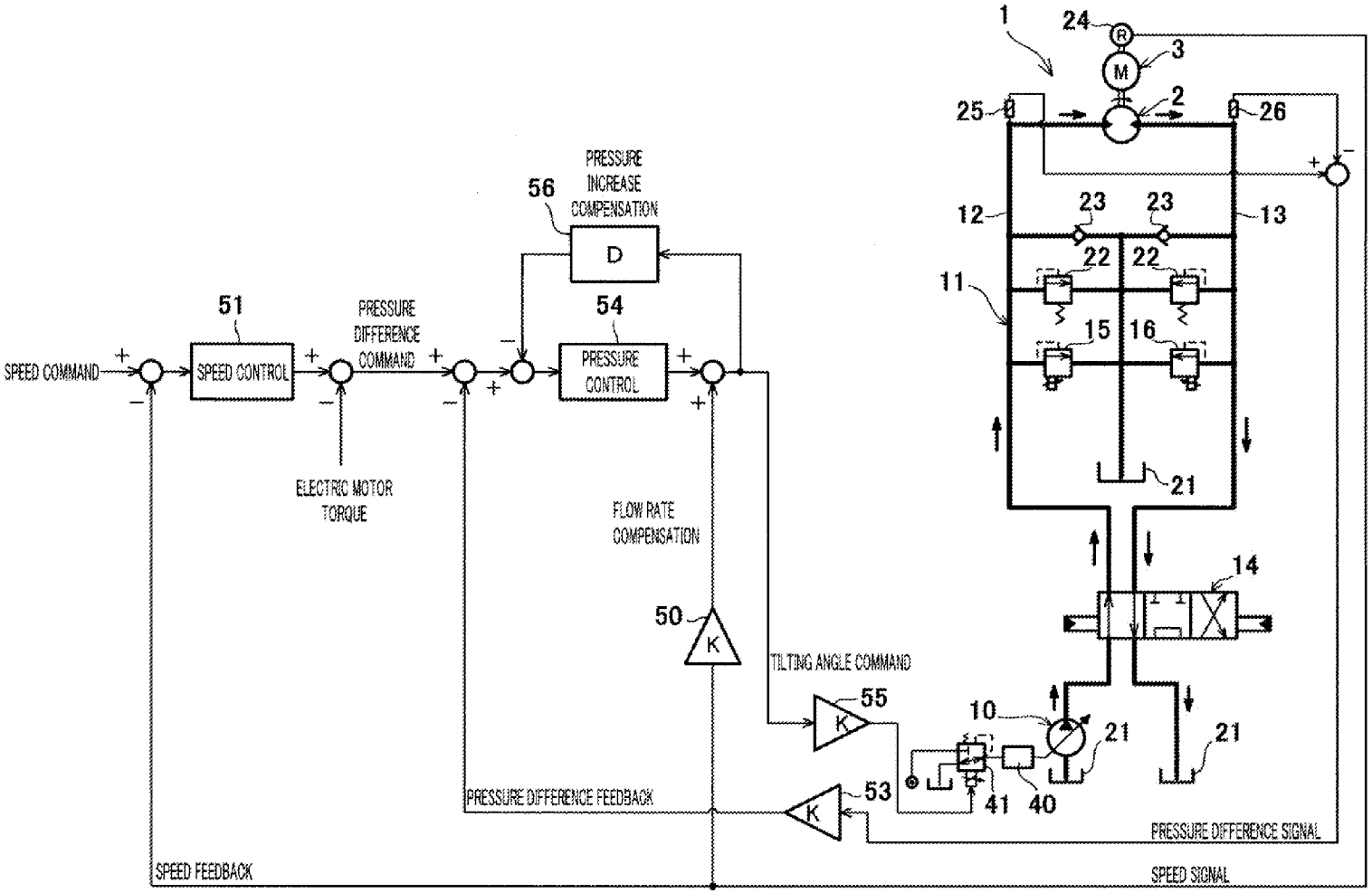
FIG. 2 is a system diagram showing a tilting angle control method of hydraulic pump in the drive controller shown in FIG. 1.

Next, the control of the tilting angle of the hydraulic pump 10 will be explained in detail based on FIG. 2. In FIG. 2, the controller 7 is omitted. As the control of the tilting angle of the hydraulic, pump 10, an actual rotation speed signal output from the rotation speed sensor 24 of the electric, motor 3 is input as the speed feedback to the speed command output from the remote control valve 5. Then, the obtained signal is subjected to speed control 51. Thus, the feedback control with respect to the speed command is performed. After that, the torque which can be output by the electric motor 3 is subtracted from the obtained signal. As a result, a pressure difference command is produced.

Then, the pressure difference signal as the pressure difference feedback is input to the produced pressure difference command through a control gain 53. The pressure difference signal is based on the operating oil pressure difference between the pressure sensors 25 and 26 provided at the suction port and discharge port of the hydraulic motor 2. The obtained signal is subjected to pressure control 54. The signal obtained after the feedback control with respect to the pressure difference command is performed is output as the tilting angle command to the solenoid-operated proportional reducing valve 41 of the hydraulic pump 10 through a control gain 55. Thus, the tilting angle of the hydraulic pump 10 is controlled.

Here, in the case of controlling the tilting, angle of the hydraulic pump 10, the responsiveness of a tilting mechanism included in the hydraulic pump 10 is generally low. Therefore, in the system diagram of FIG. 2, the responsiveness is being improved by adding flow rate compensation and pressure increase compensation to the control of the tilting angle of the hydraulic pump 10.

As the flow rate compensation, the necessary pump oil amount calculated by a control gain 50 based on the actual rotation speed of the hydraulic motor 2 obtained from the signal of the rotation speed sensor 24 provided at the electric motor 3 is added to the manipulation amount of the tilting angle command obtained after the pressure control 54. With this, the tilting angle command corresponding to the latest actual rotation speed is output as a final command. In addition, the amount of change in a pressure controller (pressure control 54) is reduced by this operation. Thus, the responsiveness of the tilting mechanism can be improved, and the dynamic range can be secured.

As the pressure increase compensation, a minor loop 56 for performing the feedback of a difference of the tilting angle command of the pump is provided between the tilting angle command having been subjected to the flow rate compensation and the pressure difference command having been corrected by the pressure difference feedback. To be specific, the control calculation of a differential action (D operation) is performed with respect to the tilting angle command of the pump, and the signal obtained after this control calculation is fed back to the pressure difference command corrected by the Pressure difference feedback. Thus, the gain in the high frequency range can be reduced, and this improves the stability of the pressure control. In other words, the difference of the tilting angle command is reflected in the difference of the ejecting pressure. Therefore, the tilting angle command is smoothed by the pressure increase compensation, so that the stability of the pressure control improves. As shown in FIG. 3B described below, regarding the pump tilting angle command, the pressure increase compensation improves the stability by reducing the gain of the high frequency range of the pressure change (shown by a dashed line 45 an example of the pump tilting angle command at the time of the change in the pump ejecting pressure) of the operating oil ejected from the hydraulic pump 10.

As above, in the present embodiment, a high-speed and stable control characteristic can be obtained by performing the flow rate compensation and the pressure increase compensation in the control of the tilting angle of the hydraulic pump 10.

By controlling the tilting angle of the hydraulic pump 10 as above, the amount of operating oil ejected from the hydraulic pump 10 can be controlled to an appropriate amount based on the speed command output from the remote control valve 5, the actual rotation speed of the hydraulic motor 2, and the pressure difference between the suction port and discharge port of the hydraulic motor 2. In addition, at the time of the normal operation, the operating oil of the hydraulic pump 10 is not discharged through the relief valve 22. Thus, the energy efficiency can be improved.

Figure 3A:
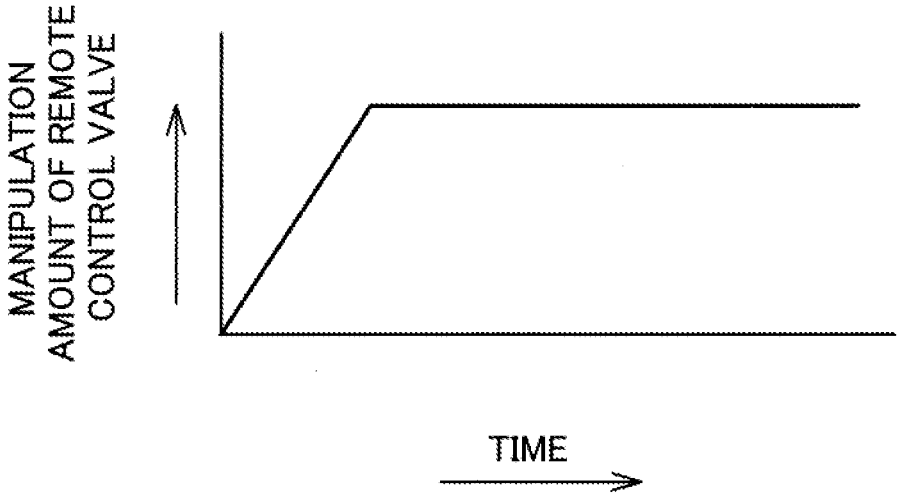
FIGS. 3A and 3B are diagrams schematically showing respective commands in the tilting angle control method shown in FIG. 2.
Figure 3B:
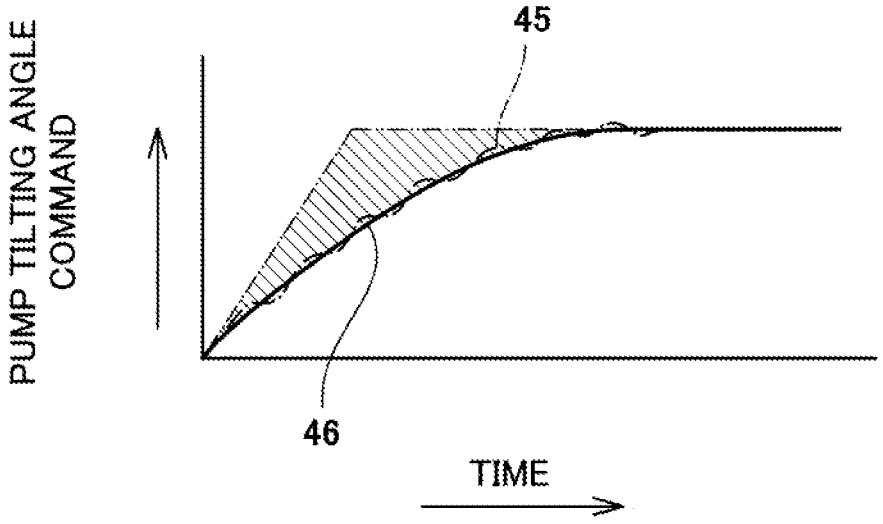

FIG. 3A shows a relation between the manipulation amount of the remote control valve and a time, and FIG. 3B shows a relation between the pump tilting angle command and a time. Regarding the relation between the change in the amount of operating oil by the control of the tilting angle of the hydraulic pump 10 and the manipulation amount of the remote control valve 5, even if the remote control valve 5 is quickly, largely manipulated as shown in FIG. 3A, the tilting angle of the hydraulic pump 10 is controlled as shown in FIG. 3B by the speed feedback such that the amount of oil ejected becomes appropriate for the actual rotation speed, the speed feedback being based on the actual rotation speed of the hydraulic motor detected by the rotation speed sensor 24 provided at the electric motor 3. Therefore, the hydraulic pump 10 does not eject the operating oil, the amount of which is larger than the amount of operating oil (solid line 46) appropriate for the actual rotation speed. Thus, the operations can be performed with high energy efficiency.

To be specific, in a conventional case, as shown by a chain double-dashed line in FIG. 3B, when the remote control valve 5 is quickly largely manipulated, the amount of operating oil corresponding to the manipulation amount is ejected. Therefore, the oil corresponding to a portion shown by diagonal lines in FIG. 3B is discharged, and this deteriorates the energy efficiency. However, by controlling the tilting angle of the hydraulic pump 10 as described above, the operating oil, the amount of which is appropriate for the actual rotation speed, is ejected from the hydraulic pump 10 as shown by a solid line 46 in FIG. 3B. With this, the amount of operating oil discharged can be reduced significantly, and the operations can be performed with high energy efficiency.

Figure 4:
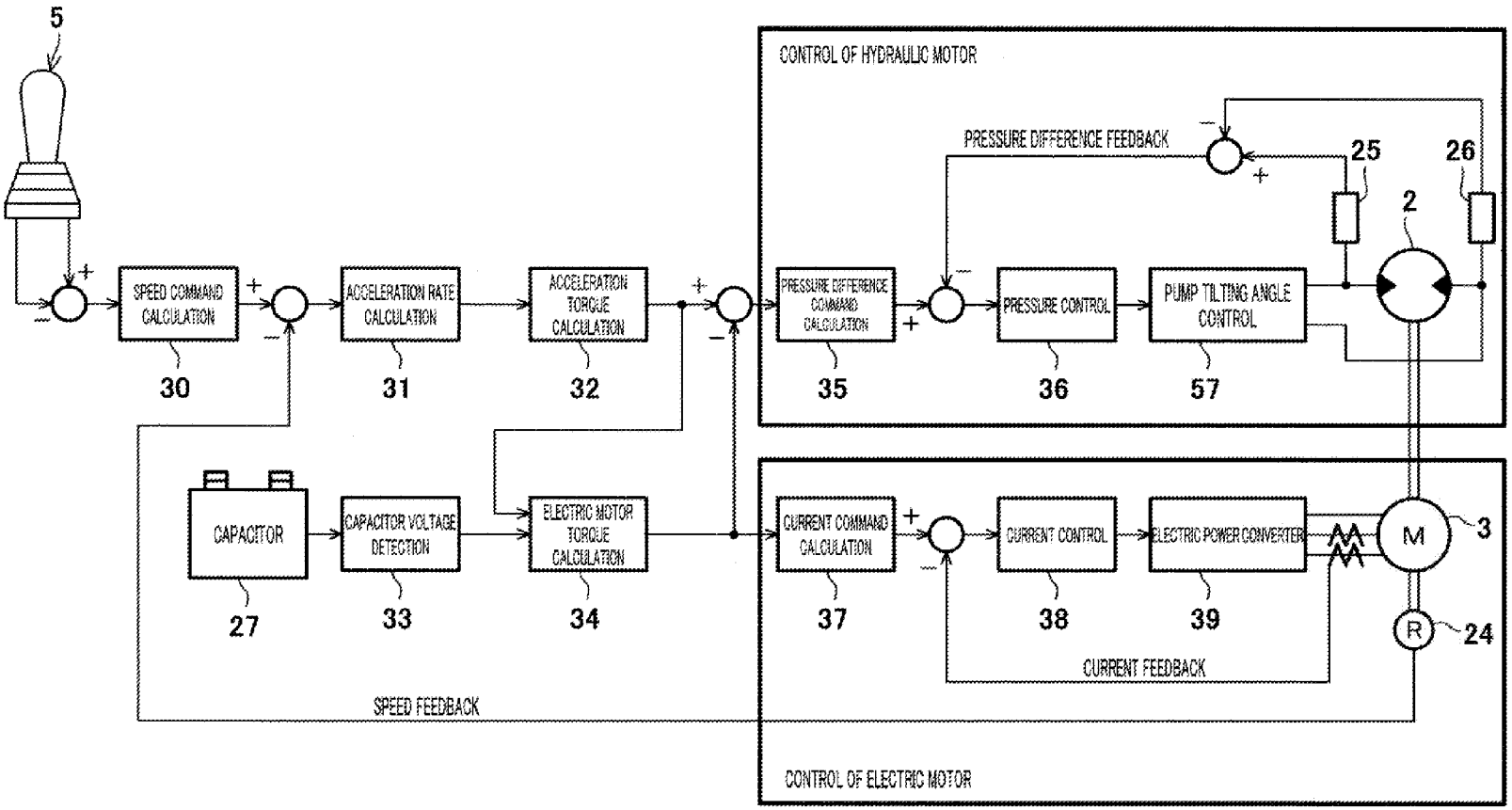
FIG. 4 is a control block diagram of the drive controller shown in FIG. 1.

As shown in FIG. 4, in the control block diagram of the drive controller 1, from the inclination direction and manipulation amount of the remote control valve 5, the speed of the revolving super structure is calculated by a speed command calculation 30. Then, based on the difference between the above speed and the speed feedback output from the rotation speed sensor 24 provided at the electric motor 3, a necessary acceleration rate is calculated by an acceleration rate calculation 31. Next, an acceleration torque of the acceleration rate is calculated by an acceleration, torque calculation 32.

Moreover, the voltage of the capacitor 27 is detected by a capacitor voltage detection 33. Based on the detected voltage, the entire torque calculated by the acceleration torque calculation 32, and the like, the torque which can be output by the electric motor 3 is calculated by an electric motor torque calculation 34. The obtained torque which can be output by the electric motor 3 is subtracted from the entire torque calculated by the acceleration torque calculation 32, and the obtained torque is used as the necessary torque of the hydraulic motor 2. In a case where the necessary torque of the hydraulic motor 2 requires a limitation (for example, in a case where the pressure of the suction port of the hydraulic motor 2 needs to be set to a certain value or higher), the torque to be output by the electric motor 3 may be calculated by subtracting the necessary torque of the hydraulic motor 2 from the entire torque.

Regarding the control of the hydraulic motor 2, the necessary torque of the hydraulic motor 2 is subjected to a pressure difference command calculation 35, and the obtained pressure difference command is compared with the pressure difference feedback output from the pressure sensors 25 and 26 configured to detect the pressure at the suction and discharge ports of the hydraulic motor 2. After that, the tilting angle command is output by a pressure control 36, and tilting angle control 57 is performed. With this, the operating oil, which has an amount by which the hydraulic motor 2 can output the torque except for the output torque of the electric motor 3, is supplied to the hydraulic motor 2, and the hydraulic motor 2 is driven.

Regarding the control of the electric motor 3, a current is calculated by a current command calculation 37 such that the torque calculated by the electric motor torque calculation 34 is output. This calculation result is compared with the current feedback supplied to the electric motor 3. After that, an electric power converter 39 is controlled by a current controlled, by current control 38. Thus, the electric motor 3 is driven. The driving of the electric motor 3 is detected by the rotation speed sensor 24, and the speed feedback is fed back to the calculation result of the speed command calculation 30.

Next, one example of an operation sequence by the drive controller 1 will be explained based on FIG. 5. The operation sequence shows time changes of the speed command output by the remote control valve 5, the speed feedback of the revolving super structure, the torque of the electric motor 3, a suction-discharge pressure difference torque of the hydraulic motor 2, and the total torque of the electric motor 3 and the hydraulic motor 2.

Figure 5:
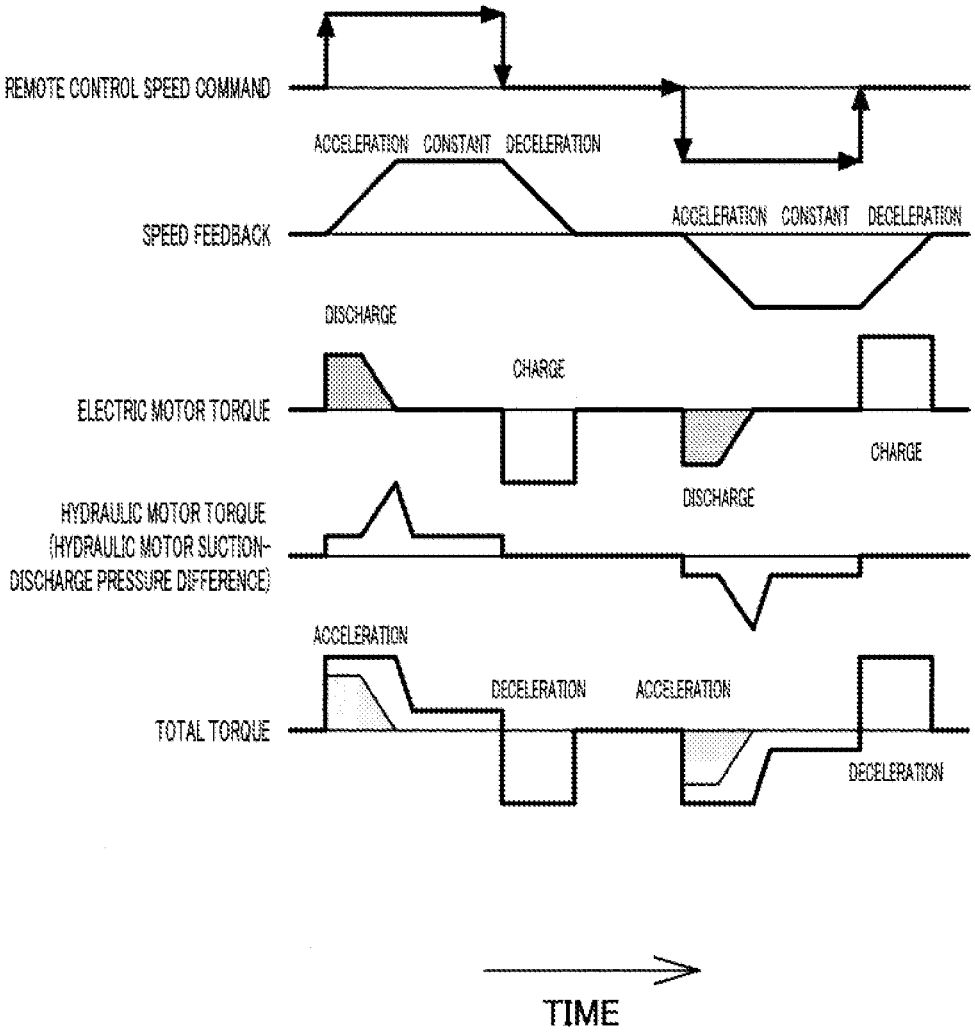
FIG. 5 is a drive sequence diagram of a revolving super structure of the drive controller shown in FIG. 1.

In the example shown in FIG. 5, the remote control valve 5 is inclined to one side to cause the revolving super structure to "accelerate" and swing at "constant speed" in one direction as shown by the speed feedback. After that, the remote control valve 5 is returned to neutral to cause the revolving super structure to "decelerate". Then, the remote control valve 5 is inclined to the other side to cause the revolving super structure to "accelerate", swing at "constant speed", and "decelerate" in the other direction.

When the remote control valve 5 is manipulated to output the speed command corresponding to an upper direction shown in FIG. 3 (corresponding to the swing in one direction), the electric motor 3 is rotated to generate predetermined torque as the torque for causing, the revolving, super structure that is the inertial body to rotate. Thus, the capacitor 27 discharges the electric power, and the hydraulic motor 2 is driven so as to compensate for the shortfall of the torque of the electric motor 3. As above, the electric motor 3 and the hydraulic motor 2 are driven such that high synthetic torque for causing the revolving super structure that is the inertial body to accelerate at the time of the start of the swing is obtained by the total of the torque of the electric motor and the torque of the hydraulic motor. To be specific, the output of the electric motor 3 is utilized to obtain the maximum energy saving effect when starting swinging the revolving super structure which is in a stop state, and the shortfall is compensated by the hydraulic motor 2. When the revolving super structure swings at constant sped, low swing torque is obtained only by the hydraulic motor 2. When the revolving super structure decelerates, the substantially entire amount of inertial energy is efficiently recovered as the electric energy by the regenerative action of the electric motor 3, and the electric energy is stored in the capacitor 27.

FIG. 5 also shows that after the above operations, the remote control valve 5 is manipulated in the opposite direction. However, since actions other than the generation of the torque in the opposite direction are the same as the above actions, explanations thereof are omitted.

As above, according to the drive controller 1 of Embodiment 1, the shortfall that is the torque obtained by subtracting the torque, which can be generated by the electric motor 3, from the entire torque which is based on the manipulation amount of the remote control valve 5 is generated by the hydraulic motor 2. In this case, the amount of operating oil for driving the hydraulic motor 2 is adjusted by controlling the tilting angle of the hydraulic pump 10. Therefore, the efficiency of the energy for driving the revolving super structure can be improved by the electric motor 3 and the hydraulic motor 2. In addition, since the swing control is performed while monitoring the voltage of the capacitor 27 and calculating the energy which can be supplied to the electric motor 3, the use efficiency of the stored energy can be improved. Further, the time for the swing operation can be shortened by a time corresponding to the assist amount of the electric motor 3, and the pump loss can be reduced.

When the hydraulic motor 2 decelerates, the pressure loss generated on the discharge side of the hydraulic motor 2 can be avoided by opening the solenoid-operated relief valve 15 or 16, and the substantially entire amount of inertial energy of the revolving super structure can be recovered as the electric energy by the regenerative action of the electric motor 3. Therefore, the drive controller 1 can be operated with high energy efficiency.

Further, to prevent swinging generated by, for example, an oil compression effect in this type of hydraulic drive when stopping the revolving super structure, the rotation speed of the electric motor 3 is observed, and the torque of the electric motor 3 is controlled at the time of the stop. Thus, riding quality can be improved. Since the torque of the electric motor 3 and the torque of the hydraulic motor 2 are individually controlled, the swing, feeling can be set freely.

Figure 6:
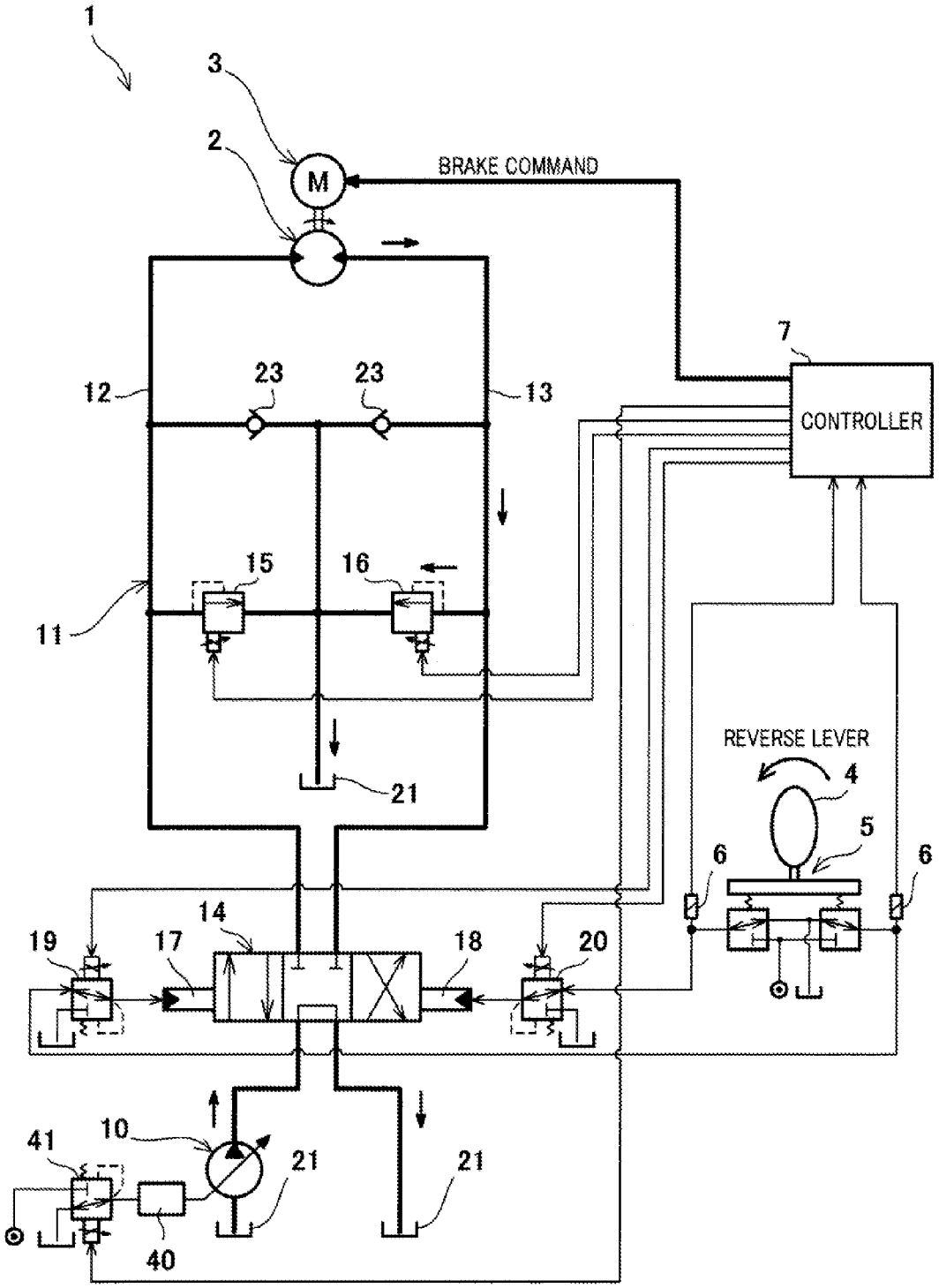
FIG. 6 is a hydraulic circuit diagram showing another control method in the drive controller shown in FIG. 1.

Here, as shown in FIG. 6, in a state where the remote control valve 5 is incline to one side to perform the swing movement and the like, a reverse lever operation may be performed, that is, the remote control valve 5 may be largely inclined in a reverse direction to quickly stop the swing movement. In a conventional hydraulic circuit, in a period of the deceleration by the reverse operation lever, a predetermined amount of operating oil is ejected from the hydraulic pump 10 in accordance with the manipulation amount of the remote control valve 5. Therefore, the problem is that the pump loss occurs largely. In FIG. 6, the same reference signs are used for the same components as in FIG. 1.

In the example shown in FIG. 6, in the period of the deceleration by the reverse lever operation, the tilting angle of the pump is set to minimum, and the control valve 14 is set to neutral. With this, the pump loss can be reduced. At this time, the controller 7 outputs a brake command to the electric motor 3 to increase the torque of the electric motor 3, or set pressure of the solenoid-operated relief valve 15 or 16 on the brake side is increased. With this, the brake force of the hydraulic motor 2 is controlled to be increased. By this control, the loss of the hydraulic pump 10 can be suppressed, and the same short deceleration time as the conventional hydraulic circuit can be maintained.

Figure 7:
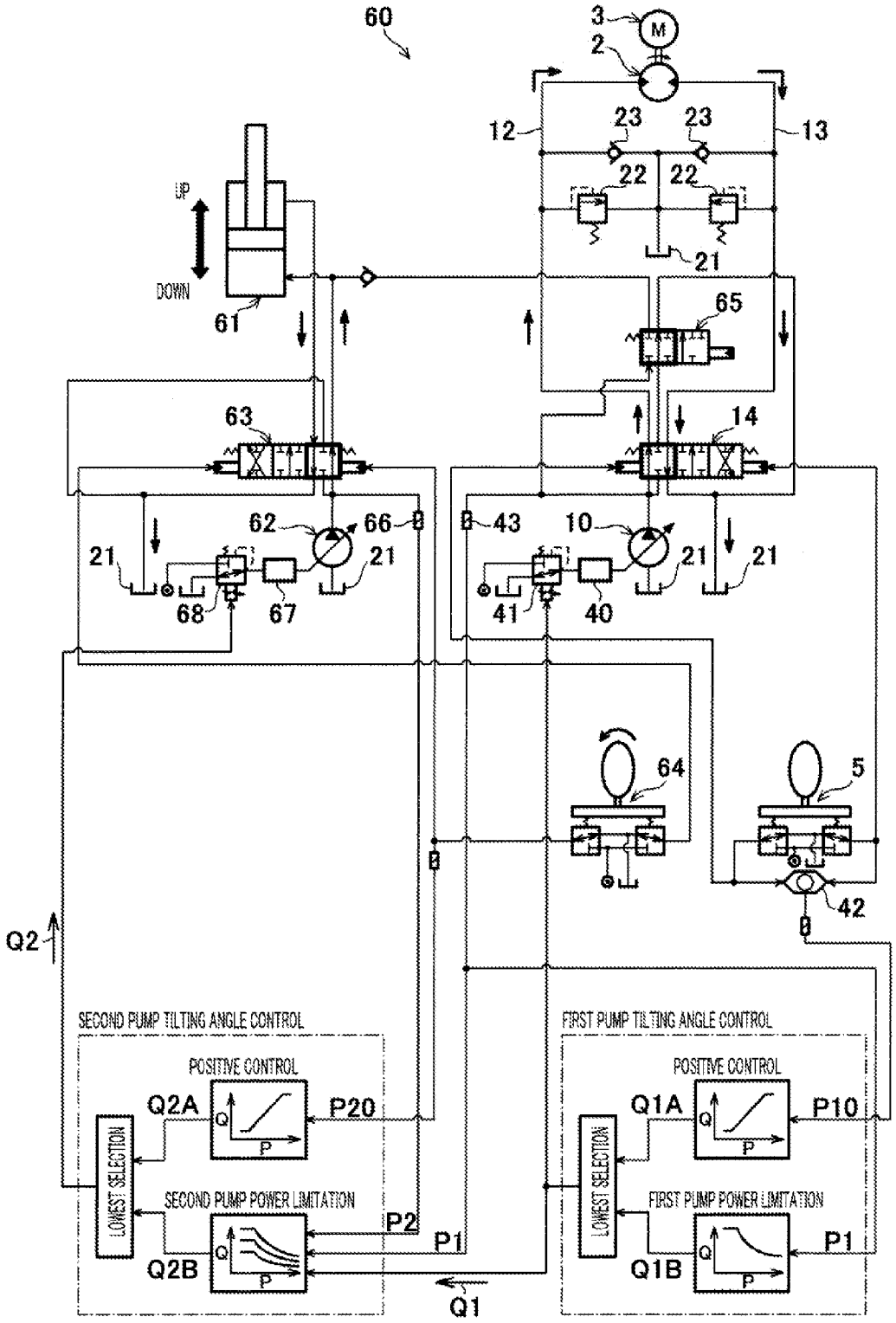
FIG. 7 is a hydraulic circuit diagram of the drive controller according to Embodiment 2 of the present invention.

As shown in FIG. 7, like the revolving super structure of the hydraulic, excavator, there is a machine configured to perform a combined manipulation, that is, perform swing manipulation of the revolving super structure and manipulation of a driven body, such as the boom. A control method of a drive controller 60 of Embodiment 2 including a plurality of driven bodies in one machine will be explained based on FIG. 7. In FIG. 7, the components regarding the controller 7 are omitted, and the same reference signs are used for the same components as in FIG. 1.

In the example shown in FIG. 7, the hydraulic motor 2 and the electric motor 3 configured to cause the revolving super structure to swing are included, and a boom cylinder 61 configured to cause the boom to move up and down is also included. In the case of this configuration, in addition to the hydraulic pump 10 (referred to as a "first hydraulic pump 10" in the explanation of FIG. 7) configured to drive the revolving super structure, a second hydraulic pump 62 configured to manipulate the boom cylinder 61 is provided. The second hydraulic pump 62 is connected to the boom cylinder 61 via a second control valve 63. By switching the second control valve 63, the boom cylinder 61 is caused to move up or down.

In addition, a boom remote control valve 64 configured to manipulate the second control valve 63 of the boom cylinder 61 is provided. The boom remote control valve 64 is manipulated to switch the second control valve 63. In the circuit configured to perform the combined manipulation, a converging valve 65 is provided on a downstream side of the control valve 14 (referred to as a "first control valve 14" in the explanation of FIG. 7). The converging valve 65 is switched by move-up manipulation of the boom remote control valve 64. With this, by the difference of control pressure between the remote control valve 5 (referred to as a "swing remote control valve 5" in the explanation of FIG. 7) and the boom remote control valve 64, the operating oil ejected from the first hydraulic pump 10 is caused to join the operating oil ejected from the second hydraulic pump 62. Thus, the operation of the boom cylinder 61 can be assisted. However, in a case where the combined manipulation in which the boom moving-up manipulation and the swing, manipulation are performed at the same time is performed, the operating oil ejected from the first hydraulic pump 10 is caused to join the operating oil ejected from the second hydraulic pump 62, and the control of the tilting angle of the first hydraulic pump 10 shown in FIG. 2 does not function effectively. Therefore, in the example shown in FIG. 7, the boom moving-up manipulation is performed only by the operating oil ejected from the second hydraulic pump 62 without causing the operating oil ejected from the first hydraulic pump 10 to join the operating oil ejected from the second hydraulic pump 62 (without switching the converging valve 65).

Then, in the circuit configured to perform the combined manipulation, the control of the tilting angle of the first hydraulic pump 10 is performed by comparing an output Q1A output by positive control based on a swing remote controller pressure signal P10 and an output Q1B output by a first pump power limitation based on a discharge pressure signal P1 of the first hydraulic pump 10 detected by the pressure sensor 43, and performing lowest selection. The swing remote controller pressure signal P10 shown in FIG. 7 is the tilting angle command shown in FIG. 2.

The power limitation is being set to the discharge pressure signal P1 of the first hydraulic pump 10. In the present example, the total of the power limitations of two pumps 10 and 62 (power limitations determined by the engine output and the like) is the power limitation of the first hydraulic pump 10. As described above, the output Q1A of the positive control and the output Q1B of the first pimp power limitation are compared with each other, and the lowest selection is performed. Thus, the solenoid-operated proportional reducing valve 41 of the first hydraulic pump 10 is controlled by the signal generated based on the lowest selection, and the tilting angle is controlled.

As the tilting angle control of the second hydraulic pump 62, an output Q2A output by the positive control and an output Q2B output by a second pump power limitation are compared with each other, the lowest selection is performed, and the obtained signal is output as a second pump ejection amount Q2. The positive control of the second hydraulic pump 62 outputs the output Q2A based on a boom remote controller pressure signal P20 of the moving-up side of the boom remote control valve 64. The output Q2B of the second pump power limitation is calculated based on a discharge pressure signal P2 of the second hydraulic pump 62 detected by the pressure sensor 66, the discharge pressure signal P1 of the first hydraulic pump 10, and a signal of an ejection amount Q1 of the first hydraulic pump 10 based on the tilting angle command of the first hydraulic pump 10 by the above lowest selection. In the present example, the power limitation of the second hydraulic pump 62 is obtained by subtracting actual power (P1×Q1) of the first hydraulic pump 10 from the total of the power limitations of two pumps 10 and 62. By this power limitation, the control operations are performed such that the total of the outputs of the pumps 10 and 62 does not exceed the drive capability of a prime mover (not shown) of the machine. The signal generated by the lowest selection is output as the tilting angle command to a solenoid-operated proportional reducing valve 68 provided at a tilting angle adjusting port 67 of the second hydraulic pump 62. Thus, the tilting angle is controlled.

In this circuit, in a case where the electric energy capable of driving the electric motor 3 is being stored in the capacitor 27 (FIG. 1), the tilting angle of the first hydraulic pump 10 is controlled by the above-described method shown in FIG. 2. Thus, the torque of the swing hydraulic motor 2 is controlled, and the boom cylinder 61 is driven by the second hydraulic pump 62.

In this case, in the case of driving the revolving super structure, the hydraulic motor 2 may be driven to compensate for the shortfall of the drive torque of the electric motor 3. Therefore, among the drive power of the hydraulic pumps 10 and 62 predetermined in the operating machine, the power other than the power of the hydraulic pump 10 necessary to drive the hydraulic motor 2 can be used as the drive power of the second hydraulic pump 62. Therefore, high power can be generated by the second hydraulic pump 62.

As above, in the case of the double pump, efficient hybrid drive maximally utilizing the stored electric energy and the drive power of the pump preset in the operating machine can be realized by individually controlling the tilting angles of the pumps 10 and 62 as described above. In addition, in the case of individually performing the tilting angle control operations of the pumps 10 and 62, a work efficiency emphasis mode (for example, a speed mode) and a fuel efficiency emphasis mode (for example, an eco mode) may be set in each of the tilting angle control operations, and an operator may select one of the modes.

As explained above, according to the above drive control method, in order to compensate by the drive torque of the hydraulic motor 2 for the shortfall that is the torque obtained by subtracting the drive torque of the electric motor 3 from the torque necessary to drive the revolving super structure, only the amount of oil necessary for the swing movement of the hydraulic motor 2 is supplied by controlling the tilting angle of the hydraulic pump 10. Therefore, without using the relief valve as the torque control unit of the hydraulic motor 2, the energy loss can be reduced. Thus, the energy efficiency for driving the revolving super structure can be unproved, and the fuel efficiency can be improved.

The substantially entire amount of inertial energy (rotational energy) of the revolving super structure is efficiently recovered as the electric energy by the regenerative action of the electric motor 3 at the time of the deceleration to be stored in the capacitor 27, and the stored electric energy is used at the time of the next acceleration of the revolving super structure. Therefore, the use efficiency of the energy improves, and the fuel efficiency of the operating machine also improves. In addition, the discharging of a greenhouse gas can be suppressed.

Further, in the above embodiment, the electric motor 3 is driven by preferentially utilizing the stored energy of the capacitor 27, and the hydraulic motor 2 compensates for the shortfall. Therefore, the quick acceleration can be realized, and the use efficiency of the stored energy can be improved.

Since the torque distribution of the hydraulic motor 2 can be adjusted by controlling the tilting angle of the hydraulic pump 10, the switching from the electric motor 3 to the hydraulic motor 2 can be performed in a shockless manner.

The above embodiment has explained an example in which the electric motor 3 is driven by preferentially utilizing the stored energy of the capacitor 27, and the hydraulic motor 2 compensates for the shortfall of the torque. However, if the amount of stored energy of the capacitor 27 is small, the revolving super structure may be rotated only by the hydraulic motor 2 without using the electric motor 3, and the above embodiment is not necessarily limited to the configuration in which the electric motor 3 is preferentially used, and the hydraulic motor 2 compensates for the shortfall.

In a case where the energy capable of driving the electric motor 3 is being stored in the capacitor 27, an electric motor torque command may be obtained by subtracting a hydraulic motor torque command from an acceleration torque command necessary for the swing, and the shortfall of the torque may be compensated by the electric motor 3.

Further, a pressure signal obtained by adding to the pressure difference command a motor back pressure feedback output from a pressure sensor 26 (right side in FIG. 2) provided on a back pressure side of the hydraulic motor 2 may be used as a relief pressure command of the solenoid-operated relief valve 15 located on the upstream side of the hydraulic motor. With this, the control pressure of the solenoid-operated relief valve 15 can be prevented from being set to be smaller than the pressure necessary for the system.

The above embodiment has explained an example in which the structure of the operating machine is the revolving super structure of the hydraulic excavator. However, the above embodiment is applicable to the structures of the other operating machines, such as revolving super structures of cranes and carriers of wheel loaders, and the above embodiment is not limited.

Further, the above embodiment is just one example, and various modifications may be made within the spirit of the present invention. The present invention is not limited to the above embodiment.

INDUSTRIAL APPLICABILITY

An operating machine drive control method according to the present invention can be utilized in a heavy machinery, such as a hydraulic excavator or a hydraulic cranes, that is, in an operating machine in which a hydraulic motor and an electric motor are provided in a drive system.

REFERENCE SIGNS LIST

1 drive controller
2 hydraulic motor (swing hydraulic motor)
3 electric motor
4 inclination handle
5 remote control valve (swing remote control valve)
6 pressure sensor
7 controller
10 hydraulic pump (first hydraulic pump)
11 hydraulic motor circuit
12, 13 oil passage
14 control valve (first control valve)
15, 16 solenoid-operated relief valve
17, 18 pilot port
19, 20 solenoid-operated proportional reducing valve
21 tank
22 relief valve
23 check valve
24 rotation speed sensor
25, 26 pressure sensor
27 capacitor
30 speed command calculation
31 acceleration rate calculation
32 acceleration torque calculation
33 capacitor voltage detection
34 electric motor torque calculation
35 pressure difference command calculation
36 pressure control
37 current command calculation
38 current control
39 electric power converter
40 tilting angle adjusting port
41 solenoid-operated proportional reducing valve
42 high-pressure selection
43 pressure sensor
45 example of pump tilting angle command when pump discharge pressure changes
46 example of pump tilting angle command appropriate for actual rotation speed
50 control gain (speed feedback)
51 speed control
53 control gain (pressure difference feedback)
54 pressure control
55 control gain (tilting angle command)
56 minor loop
57 tilting angle control
60 drive controller
61 boom cylinder

62 second hydraulic pump
63 second control valve
64 boom remote control valve
66 pressure sensor
67 tilting angle adjusting port
68 solenoid-operated proportional reducing valve

The invention claimed is:

1. A drive control method of an operating machine configured to drive a structure by a hydraulic motor and an electric motor configured to cooperate with the hydraulic motor, the hydraulic motor being configured to be driven by operating oil supplied from a hydraulic pump through a control valve, the hydraulic pump being configured to be able to change an ejection flow rate by control of a tilting angle of the hydraulic pump, the method comprising the steps of:

causing a speed command, generated based on a manipulation amount of a remote control valve configured to determine an operation amount of the structure, to be subjected to speed feedback control, performed based on an actual rotation speed of the hydraulic motor, and pressure difference feedback control, performed based on an operating oil pressure difference between a suction port and a discharge port of the hydraulic motor, to generate a tilting angle command such that the operating oil, the amount of which is necessary at the actual rotation speed of the hydraulic motor, is ejected;

controlling the tilting angle of the hydraulic pump; and at the time of deceleration by a reverse lever operation of the remote control valve, minimizing the tilting angle of the hydraulic pump and setting the control valve to a neutral position to generate a deceleration resistance on the hydraulic motor.

2. The drive control method according to claim 1, further comprising the step of causing the tilting angle command to be subjected to flow rate compensation such that the operating oil, the amount of which is appropriate for the actual rotation speed of the hydraulic motor, is supplied, the flow rate compensation being performed in such a manner that a speed signal generated based on the actual rotation speed is added through a control gain to a signal obtained by the pressure difference feedback control.

3. The drive control method according to claim 2, further comprising the step of performing pressure increase compensation by providing a minor loop between the tilting angle command obtained by the flow rate compensation and a pressure difference command to which the pressure difference feedback signal is input, the minor loop being configured to perform feedback of a difference of the tilting angle command.

4. The drive control method according to claim 2, wherein set pressure of a solenoid-operated relief valve provided on an oil passage extending between the hydraulic pump and the hydraulic motor is controlled such that the operating oil ejected from the hydraulic pump beyond a set value of the tilting angle command is released.

5. The drive control method according to claim 1, further comprising the steps of:

at the time of the deceleration of the hydraulic motor, causing the operating oil to circulate in a circuit of the hydraulic motor, and recovering an entire amount of deceleration energy in a capacitor by using the electric motor; and minimizing the tilting angle of the hydraulic pump and releasing an entire amount of ejected oil to a tank through the control valve.

6. The drive control method according to claim 1, further comprising the step of at the time of initial acceleration of the structure, generating the tilting angle command of the hydraulic pump such that a shortfall that is torque obtained by subtracting drive torque, which is able to be output by the electric motor, from torque necessary for the acceleration of the structure is compensated by drive torque of the hydraulic motor.

7. A drive control method of an operating machine, the operating machine including:

a hydraulic motor configured to be driven by operating oil supplied from a hydraulic pump through a control valve based on a manipulation amount of remote control valve configured to determine an operation amount of a structure, the hydraulic pump being configured to be able to change an ejection flow rate by control of a tilting angle of the hydraulic pump; and a second hydraulic actuator configured to be driven by the operating oil supplied from a second hydraulic pump based on a manipulation amount of a second remote control valve, the operating machine being configured to drive the structure by the hydraulic motor and an electric motor configured to cooperate with the hydraulic motor, the method comprising the steps of:

causing a speed command, generated based on the manipulation amount of the remote control valve, to be subjected to speed feedback control, performed based on an actual rotation speed of the hydraulic motor, and pressure difference feedback control, performed based on an operating oil pressure difference between a suction port and a discharge port of the hydraulic motor, to generate a tilting angle command such that the operating oil, the amount of which is necessary at the actual rotation speed of the hydraulic motor, is ejected;

comparing a signal generated based on the tilting angle command of the hydraulic pump and a signal generated based on a power limitation of the hydraulic pump and performing lowest selection;

controlling the tilting angle of the hydraulic pump in accordance with a signal generated by the lowest selection;

comparing a signal generated based on the manipulation amount of the second remote control valve and a signal generated based on a power limitation of the second hydraulic pump and performing the lowest selection, the power limitation being a power limitation obtained by subtracting actual power of a first hydraulic pump from a total of power limitations of the two pumps; and controlling the tilting angle of the second hydraulic pump in accordance with a signal generated by the lowest selection.

8. A drive control method of an operating machine configured to drive a structure by a hydraulic motor and an electric motor configured to cooperate with the hydraulic motor, the hydraulic motor being configured to be driven by operating oil supplied from a hydraulic pump through a control valve, the hydraulic pump being configured to be able to change an election flow rate by control of a tilting angle of the hydraulic pump, the method comprising the steps of:

causing a speed command, generated based on a manipulation amount of a remote control valve configured to determine an operation amount of the structure, to be subjected to speed feedback control, performed based on an actual rotation speed of the hydraulic motor, and pressure difference feedback control, performed based on an operating oil pressure difference between a suction port and a discharge port of the hydraulic motor, to generate a tilting angle command such that the operating oil, the amount of which is necessary at the actual rotation speed of the hydraulic motor, is ejected;

controlling the tilting angle of the hydraulic pump;

causing the tilting angle command to be subjected to flow rate compensation such that the operating oil, the amount of which is appropriate for the actual rotation speed of the hydraulic motor, is supplied, the flow rate compensation being performed in such a manner that a speed signal generated based on the actual rotation speed is added through a control gain to a signal obtained by the pressure difference feedback control; and performing pressure increase compensation by providing a minor loop between the tilting angle command obtained by the flow rate compensation and a pressure difference command to which the pressure difference feedback signal is input, the minor loop being configured to perform feedback of a difference of the tilting angle command.

* * * * *